US008712762B2

(12) United States Patent
Dubbelboer et al.

(10) Patent No.: US 8,712,762 B2
(45) Date of Patent: Apr. 29, 2014

(54) NOISE SUPPRESSION IN SPEECH SIGNALS

(75) Inventors: Finn Dubbelboer, Amsterdam (NL); Tammo Houtgast, Amsterdam (NL)

(73) Assignee: Vereniging voor Christelijk Hoger Onderwijs, Wetenschappelijk Onderzoek en Patiëntenzor, Amsterdam (NL)

( * ) Notice: Subject to any disclaimer, the term of this patent is extended or adjusted under 35 U.S.C. 154(b) by 469 days.

(21) Appl. No.: 12/670,944

(22) PCT Filed: Jul. 27, 2007

(86) PCT No.: PCT/NL2007/050378

§ 371 (c)(1),
(2), (4) Date: Apr. 28, 2010

(87) PCT Pub. No.: WO2009/017392

PCT Pub. Date: Feb. 5, 2009

(65) Prior Publication Data

US 2010/0211383 A1 Aug. 19, 2010

(51) Int. Cl.
*G10L 21/00* (2013.01)

(52) U.S. Cl.
USPC ..... 704/205; 704/226; 704/233

(58) Field of Classification Search
None
See application file for complete search history.

(56) References Cited

U.S. PATENT DOCUMENTS

| | | | | |
|---|---|---|---|---|
| 5,133,013 | A | 7/1992 | Munday | |
| 2005/0031064 | A1 * | 2/2005 | Kolze et al. | 375/350 |
| 2005/0143988 | A1 * | 6/2005 | Endo et al. | 704/226 |
| 2006/0072658 | A1 * | 4/2006 | Yasuda et al. | 375/238 |
| 2006/0256764 | A1 * | 11/2006 | Yang et al. | 370/342 |

FOREIGN PATENT DOCUMENTS

EP 0 661 689 A2 7/1995

OTHER PUBLICATIONS

International Search Report; PCT/NL/2007/050378; Sep. 25, 2007.
Farès Abda, et al:. "Non-Linear Weighting Function for Non-Stationary Signal Denoising", Acoustics, Speech and Signal Processing, 2006. ICASSP 2006 Proceedings, 2006 IEEE International Conference on Toulouse.

* cited by examiner

*Primary Examiner* — Leonard Saint Cyr
(74) *Attorney, Agent, or Firm* — Jennifer E. Lacroix; DLA Piper LLP US

(57) ABSTRACT

During speech processing a filter adjusts a spectral envelope of an input speech signal with a frequency dependent adjustment factor. The adjustment factors for respective spectral components are selected dependent on the input speech signal. The factor is set to a first or second non-zero value, the second value being smaller than the first value, when a strength average for the spectral component is above and below a threshold value respectively.

8 Claims, 3 Drawing Sheets

NOISE SUPPRESSION IN SPEECH SIGNALS

The invention relates to a method and apparatus for processing speech signals.

U.S. Pat. No. 5,133,013 describes noise suppression in signals that contain speech. As is well known, a Wiener filter can be employed to suppress noise. A Wiener filter increasingly suppresses spectral components when they contain relatively more noise and less real signal. The filter coefficients of the Wiener filter are selected to minimize the expected mean square deviation between the filtered signal and a notional noise free component of the input signal. This results in a filter that multiplies each spectral component of the input signal with a suppression factor S/(S+N) that is proportional to the ratio of the expected spectral density S of the noise free signal and the expected spectral density (S+N) of the input signal with noise at the frequency of the spectral component. However, to apply Wiener filtering a reliable estimate of the signal to noise spectral density is needed.

It is also known to use dynamically estimated spectral densities in the computation of the suppression factor. In this case, the expected spectral density (S+N) of the input signal with noise is replaced by a computed spectral density I of the input signal in some time interval, and the spectral density S of the noise free signal is determined by subtracting an expected spectral density N of the noise from computed spectral density I of the input signal.

In effect, this results in a non-linear filter, which identically passes spectral components from the input signal with large spectral density I and attenuates the input signals when the spectral density I is near or below the spectral density N of the noise. U.S. Pat. No. 5,133,013 uses the term "knee" for the transition between passing signals identically and passing attenuated signals. U.S. Pat. No. 5,133,013 notes that a non-linear filter may be used that completely suppresses spectral components with a spectral density below the knee. However, such a filter is rejected, because it introduces unacceptable distortion. Instead, more gradual suppression is used, which approximate complete suppression, along the lines of a Wiener filter. U.S. Pat. No. 5,133,013 uses a predetermined knee position and adapts the input signal gain, to ensure that the knee lies at about the noise level.

EP 661689 describes a telephone speech signal processing method wherein suppression factors are selected for respective time frames and the entire speech signal in the time frames, or to a high or low frequency part of the speech signal. EP 661689 proposes to pass the speech signal identically when its mean amplitude is above a first threshold, and to apply an increasingly smaller suppression factor, which is inversely proportional to the mean amplitude when the mean amplitude is below the first threshold. EP 661689 mentions that the suppression factor can be kept constant when the mean amplitude is below a second threshold, which is smaller than the first threshold. This is said to prevent too intense noise suppression for small noise.

Although such techniques reduce the mathematically expected mean square deviation between the filtered signal and a notional noise free component of the input signal, it has been found that their effect on intelligibility of speech is limited. In some case intelligibility hardly changed, even though the signal to noise ratio improved.

A possible explanation for this may be that the known methods of noise suppression introduce artifacts that may be perceived as speech-like, while suppressing noise that can mostly be distinguished by the human auditory system anyway.

Among others, it is an object to improve intelligibility of speech signals. A speech processing apparatus according to claim 1 is provided. Herein an amplitude adjustment factor with a first or second value is used, dependent on signal strength, with a sharp transition between the first and second value as a function of the signal strength. Thus the number of spectral components with mutually different adjustment factors is kept at a minimum, so that errors in signal strength fluctuations have a minimal effect. It has been found that this increases intelligibility.

These and other objects and advantageous aspects will become apparent from a description of exemplary embodiments, using the following figures.

Figure 1:
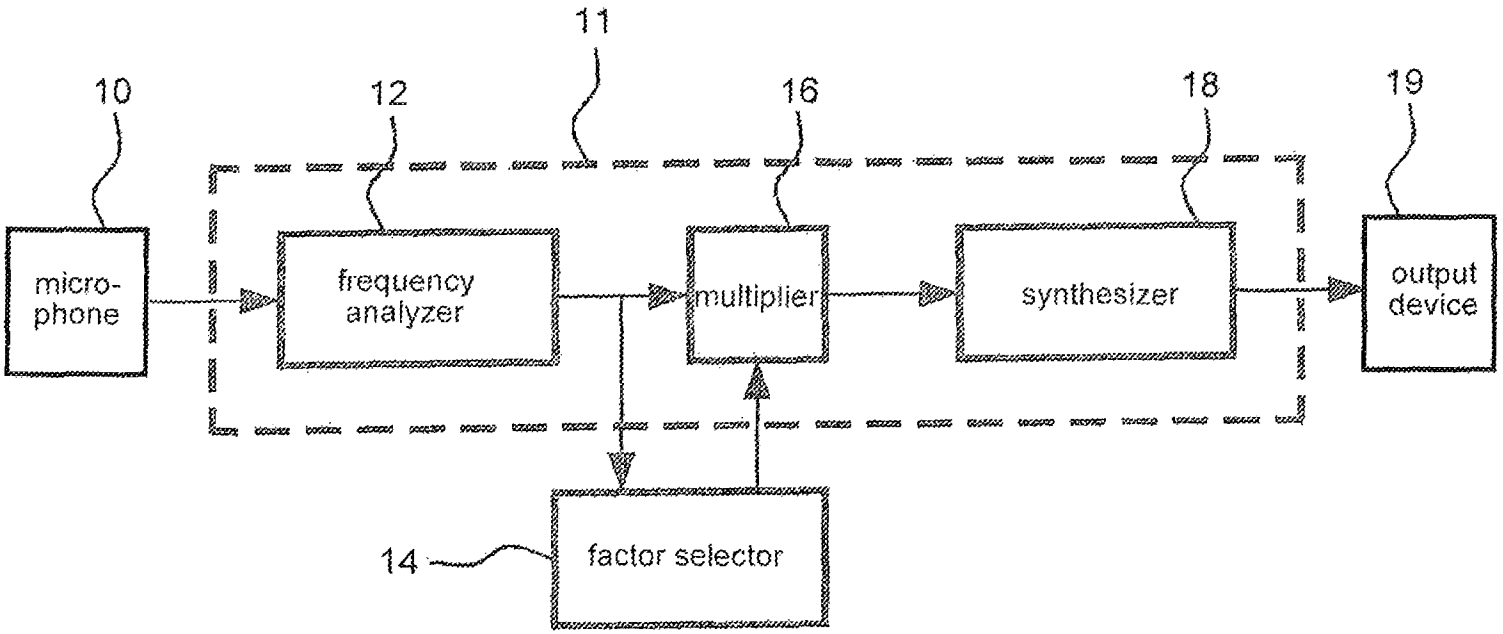
FIG. 1 shows a speech processing apparatus

FIG. 1 shows a speech processing apparatus, comprising a microphone 10, a filter 11, a factor selector 14 and an output device 19. Filter 11 comprises a frequency analyzer 12, a multiplier 16 and a synthesizer 18. Microphone 10 has an output coupled to an input of frequency analyzer 12. Factor selector 14 has an input coupled to an output of frequency analyzer 12. Multiplier 16 has a first input coupled to the output of frequency analyzer 12 and a second input coupled to an output of factor selector 14. Multiplier 16 has an output coupled to synthesizer 18, which has an output coupled to output device 19.

In operation microphone 10 picks up a speech signal which may contain additional noise. Frequency analyzer 12 analyses the speech signal into a plurality of components for respective frequency bands. Digital processing may be used, the speech signal being digitized before actual analysis. Frequency analysis may be performed by taking digitized speech signal samples for a time window in the speech signal and computing their Fourier transform. Multiplier 16 multiplies the components each by a respective factor. Multiplier 16 may be configured to perform the multiplications successively for different, frequencies in the Fourier transform results for the window for example. Synthesizer 18 reassembles the multiplied signal components and output device 19 outputs the reassembled signal for use by a human hearer.

Factor selector 14 selects the factors used by multiplier 16. In an embodiment factor selector 14 selects the factor for each component based on the absolute value of the component, using a factor of one if the absolute value exceeds a threshold T and a value F that is less than one if the absolute value does not exceed the threshold.

Figure 2:
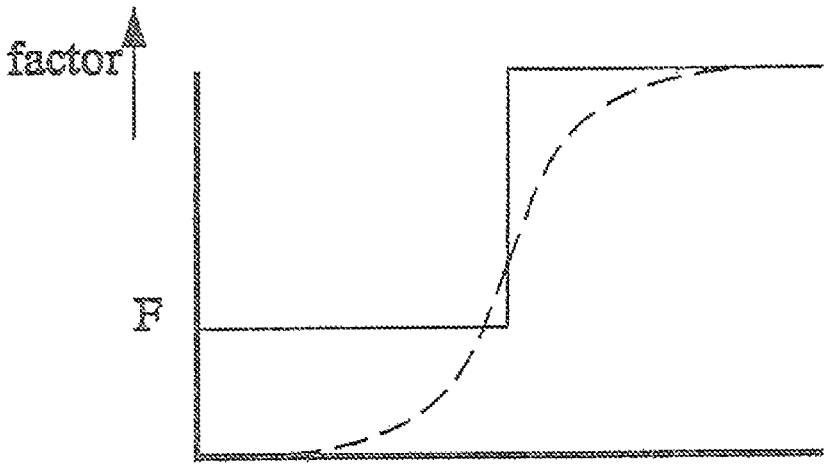
FIG. 2 shows a gain function

FIG. 2 illustrates the factor that is selected by factor selector 14 as a function of the absolute value of the component as a solid line. For reference, a typical factor as a function of absolute value according to a Wiener filter is shown as a dashed line. It may be noted that the relation used by factor selector 14 ensures that the relative strength of different signal components below the threshold is preserved. In particular, the relative strength for these components is not sensitive to noise, because it does not depend on estimates of signal amplitude. Also, temporal variations of the factor for a spectral component, due to fluctuations in the estimated signal strength in the spectral component are avoided for small signal strengths. Thus, the introduction of speech-like artifacts, such as noise modulation, is minimized. The relative strength of different signal components above the threshold is also preserved, but these strengths were already less sensitive to noise in the estimated signal amplitudes. Only the relative strength of components with amplitudes on different sides of the threshold is affected.

Moreover, it may be noted that this relation between the factor and the absolute value of the component introduces a discontinuity at the threshold T. Although such a discontinuity may introduce some artifacts, it has been found that for the purpose of intelligibility it is more effective to accept this than to introduce noise sensitive factor differences between different spectral components by using a more gradual transition. For intelligibility it is more effective to minimize the number of relative amplitude changes between different components.

Figure 3:
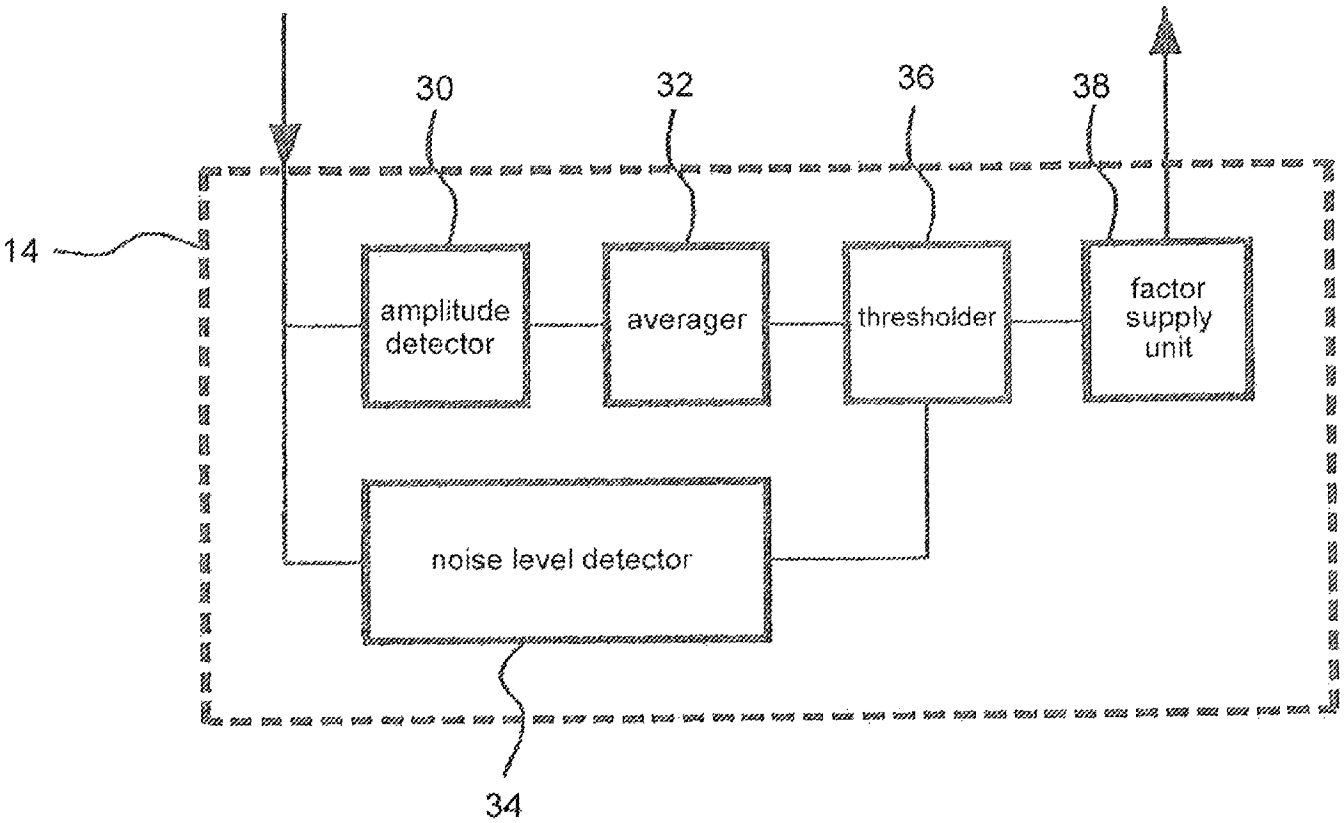
FIG. 3 shows a factor selector

FIG. 3 shows an embodiment of factor selector 14. In this embodiment the factor selector comprises an amplitude detector 30, an averager 32, a noise level detector 34, a thresholder 36 and a factor supply unit 38. Amplitude detector 30 has an input for receiving the component signals from the frequency analyzer (not shown). Averager 32 has an input coupled to an output of amplitude detector 30 and an output coupled to thresholder 36. Thresholder 36 has an output coupled to a selection control input of factor supply unit 38, which has an output coupled to the second input of the multiplier (not shown). Factor supply unit 38 is configured to supply a factor of one or F dependent on the result of thresholding. Noise level detector 34 is coupled between amplitude detector and thresholder 36.

Averager 32 computes averages for each spectral component at respective time points, by averaging over nearby time points and nearby frequencies. In one example, wherein frequency analyzer outputs spectral components for respective time frames, the average may be taken over the absolute squares of the spectral components for the N1 nearest frequencies on either side of the frequency for which the average is computed and that frequency itself. Similarly the average may be taken over the components for 2*N2 preceding time frames, or N2 preceding frames and N2 following frames. This average may be computed as a running average, using the average computed for the preceding time frame.

Noise level detector 34 determines the threshold level for the average signal amplitude from an estimation of the noise level. In an embodiment noise detector detects time frames wherein noise but no speech is present and computes average amplitudes of the noise for respective spectral components in those time frames in a similar way as in which averager 32 computes the average signal amplitudes of the spectral components. Speech/noise detectors are known per se. In this embodiment the threshold for each spectral component is set as a factor times the computed average noise for the spectral component. In an embodiment this has the effect of comparing a frequency independent threshold T with a computed quantity $$(\langle|Y|^2\rangle-\langle|N|^2\rangle)/\langle|N|^2\rangle$$

wherein the brackets denote averaging (not necessarily over the same averaging window for Y and N), $|Y|^2$ denotes the squared amplitude of the spectral components of the signal and $|N|^2$ denotes the squared amplitude of the signal in time frames where speech has been detected to be absent.

As may be noted this technique requires selection of only a limited number of design parameters: the threshold T, the factor F, and the numbers of spectral components N1, N2 used to average the signal amplitude. These parameters may be freely chosen. For example, these parameters may be set experimentally, by listening to speech produced using specific parameter values and varying the parameter values to optimize intelligibility. In an experiment improved intelligibility was obtained when the threshold T was set to 1, F was set to 0.5, and N1 was set to 1. The result could be optimized by varying N2. It was found that a pronounced optimum occurred for N2 at about 9.

Surprisingly, it was found that the value of T for optimum intelligibility varied with the value selected for N2. When N2 increases the noise power increasingly approaches its expectation value, with the effect that the risk of unintended suppression of speech reduces. Accordingly, T can be set lower. The optimal value of T was found to vary with the logarithm of N2. An experimental relation was found approximately according to $$T=10^{10}\log 9/N2$$

However, even without selecting such optimal values an increase of intelligibility was found, both for persons with normal hearing and persons with hearing defects. The factor F may be set lower or higher, for example anywhere in the range from 0.1 to 0.8 and larger values of N1 may be used. Preferably, a non-zero factor is used, to prevent that spectral components with strong noise and some speech component are completely suppressed. Thus, the brain is nor prevented from contextual recovery of the speech component.

Although a specific embodiment has been shown by way of example, it should be realized that in practice many variations are possible. For example, filter 11 may be implemented in different ways. Instead of analysis and synthesis with intermediate multiplication a temporal convolution may be used, using filter coefficients determined from the spectral adjustment factors. Instead of analysis by Fourier transforming, a filter bank may be used with filters for respective frequency bands. Instead of multiplying spectral components (i.e. complex numbers that have an amplitude and phase), the amplitudes of the spectral components may be extracted, multiplied with the factors and recombined with the phase. Instead of the amplitudes the squares of the amplitudes may be multiplied with correspondingly modified factors. Thresholder 36 may compute the threshold from the noise strength, or equivalently the noise strength and the signal strength may be used to compute a signal to noise ratio, which is subsequently compared to a threshold.

Filter 11 and factor selector 14 may be implemented by means of a programmable computer circuit such as a programmable signal processor circuit, programmed with a program that causes the computer to perform the described functions. Alternatively, all or part of filter 11 and factor selector 14 may be implemented as dedicated hardware circuits, designed to perform the described functions.

What is claimed is:

1. A speech processing apparatus comprising:

a filter, of a processor, configured to adjust a spectral envelope of an input speech signal with a frequency dependent adjustment factor;

a factor selector for selecting the adjustment factor for respective spectral components each dependent on the input speech signal, the factor selector being configured to select the factor between a first or second non-zero value, the second value being smaller than the first value, when a strength average for the spectral component is above and below a threshold value respectively, whereby a relative strength of different spectral components below the threshold value is preserved;

wherein the filter is configured to compute sets of spectral components for a series of time frames and to compute adjusted spectral components, wherein the spectral components have been adjusted by the adjustment factors;

wherein the factor selector comprising an averager configured to compute the strength average for the spectral component for each time frame by averaging over a plurality of the time frames adjacent the time frame for which the strength average is computed.

2. A speech processing apparatus according to claim 1, wherein the filter is configured to compute sets of spectral components each for a series of time frames and to compute adjusted spectral components wherein the spectral components have been adjusted by the adjustment factors, the factor selector comprising an averager configured to compute the strength average for the spectral component for each time frame by averaging over a plurality of the time frames adjacent the time frame for which the strength average is computed.

3. A speech processing apparatus according to claim 1, wherein the factor selector comprises a noise level detector, the factor selector being configured to set the threshold in proportion to a detected noise level.

4. A speech processing apparatus according to claim 2, wherein the frames adjacent the time frame for which the strength average is computed consist of N2 preceeding frames and N2 following frames, and wherein the factor selector comprises a noise level detector, the factor selector being configured to set the threshold in proportion to a detected noise level, with a proportionality factor about equal to $10\times^{10}\log 9/N2$.

5. A. speech processing apparatus according to claim 1, wherein the strength average is an average of squares of amplitudes of the spectral components,

6. A speech processing apparatus according to claim 1,wherein the factor selector is configured to use a factor selection whereby the relative strength of different spectral components above the threshold is also preserved.

7. A method of processing a speech signal, the method comprising:

adjusting a spectral envelope of the speech signal with a frequency dependent adjustment factor;

selecting the adjustment factor for respective spectral components each dependent on the input speech signal, the factor being selected between a first or a second non-zero value, the second value being smaller than the first value, when a strength average for the spectral component is above and below a threshold value respectively, whereby a relative strength of different of different spectral components below the threshold value is preserved;

computing sets of spectral components for a series of time frames and to compute adjusted spectral components wherein the spectral components have been adjusted by the adjustment factors;

computing the strength average for the spectral component for each time frame by averaging over a plurality of the time frames adjacent the time frame for which the strength average is computed.

8. A computer program product, of a device, comprising a program of instructions for a programmable computer, which, when executed by the computer, cause the computer to perform the method of claim 7.

* * * * *

UNITED STATES PATENT AND TRADEMARK OFFICE

CERTIFICATE OF CORRECTION

PATENT NO. : 8,712,762 B2
APPLICATION NO. : 12/670944
DATED : April 29, 2014
INVENTOR(S) : Dubbelboer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 764 days.

Signed and Sealed this
Twenty-ninth Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,712,762 B2
APPLICATION NO. : 12/670944
DATED : April 29, 2014
INVENTOR(S) : Finn Dubbelboer et al.

It is certified that error appears in the above-identified patent and that said Letters Patent is hereby corrected as shown below:

TITLE PAGE,

Item [73], Assignee, replace "Vereniging voor christelijk hoger onderwijs, wetenschappelijk onderzoek en patiëntenzor" with --Vereniging voor christelijk hoger onderwijs, wetenschappelijk onderzoek en patiëntenzorg--

Signed and Sealed this
Seventeenth Day of May, 2016

Michelle K. Lee

Michelle K. Lee
*Director of the United States Patent and Trademark Office*